US006450891B1

(12) United States Patent
Dubeta

(10) Patent No.: US 6,450,891 B1
(45) Date of Patent: Sep. 17, 2002

(54) SLIDE APPARATUS

(76) Inventor: David J. Dubeta, 4633 44th Street, Sylvan Lake, Alberta (CA), T4S 1L1

( * ) Notice: Subject to any disclaimer, the term of this patent is extended or adjusted under 35 U.S.C. 154(b) by 0 days.

(21) Appl. No.: 09/620,560

(22) Filed: Jul. 20, 2000

Related U.S. Application Data

(60) Provisional application No. 60/157,842, filed on Oct. 6, 1999.

(51) Int. Cl.[7] ..... A63G 21/18

(52) U.S. Cl. ..... 472/117; 472/116; 104/69

(58) Field of Search ..... 472/116, 117, 472/88, 89, 90; 104/53, 69, 70; 182/48, 51, 52, 49

(56) References Cited

U.S. PATENT DOCUMENTS

| | | | | |
|---|---|---|---|---|
| 1,133,489 A | * | 3/1915 | Mauck | 472/116 |
| 3,830,161 A | | 8/1974 | Bacon | |
| 3,923,301 A | | 12/1975 | Myers | |
| 4,145,142 A | | 3/1979 | Becker et al. | |
| 4,149,710 A | | 4/1979 | Rouchard | |
| 4,198,043 A | | 4/1980 | Timbes et al. | |
| 4,339,122 A | * | 7/1982 | Croul | 472/117 |
| 4,805,896 A | | 2/1989 | Moody | |
| 4,910,814 A | | 3/1990 | Weiner | |
| 5,011,134 A | | 4/1991 | Langford | |
| 5,020,465 A | | 6/1991 | Langford | |
| 5,069,443 A | * | 12/1991 | Shiratori | 472/116 |
| 5,230,662 A | | 7/1993 | Langford | |
| 5,453,054 A | | 9/1995 | Langford | |
| 5,779,553 A | | 7/1998 | Langford | |

FOREIGN PATENT DOCUMENTS

| | | |
|---|---|---|
| DE | 810 483 | 8/1951 |
| DE | 38 12 435 | 4/1988 |

OTHER PUBLICATIONS

"Sidewinder MKII/Typical Plan Layout", Waterfun Products Inc., Sylvan Lake, Alberta, Canada, dated Jan. 29, 1994, one(1) page advertising blueprint.

* cited by examiner

*Primary Examiner*—Kien T. Nguyen
(74) *Attorney, Agent, or Firm*—Shlesinger, Arkwright & Garvey LLP

(57) ABSTRACT

Slide apparatus includes at least one trough and a switchback trough or a switchback connected to the trough. The switchback is oriented and configured for changing the direction of travel or a user or a passenger, such as a user seated in an inner tube, from a first direction into a second direction. Multiple troughs and switchback elements may be provided so as to maximize the length of time during which a user slides, yet without increasing water usage, energy requirements, and space requirements. A switchback element may be configured for reversing the direction of travel of the user from more than 0° to 180° or more. The switchback element may be configured for directing passengers in different directions along different paths, and yet, without a dividing wall therebetween, thanks to the configuration of the switchback elements.

82 Claims, 7 Drawing Sheets

SLIDE APPARATUS

CROSS REFERENCE TO RELATED APPLICATIONS

This application claims the priority of U.S. application Ser. No. 60/157,842, filed Oct. 6, 1999, which is incorporated herein by reference.

FIELD OF THE INVENTION

The invention relates to amusement devices. More particularly, the invention relates to amusement devices sufficiently large so as to carry passengers and be placed in amusement parks and public recreation areas. Even more particularly, the invention relates to amusement rides, such as water slides, which use water to enhance the sliding of passengers or individual riders down substantially predetermined pathways.

BACKGROUND OF THE INVENTION

Slides, with or without the addition of water on the sliding surface thereof, which allow passengers or riders to slide downwardly into a stationary or moving body of water, have long been known.

Typically, early slides had relied on substantially straight downwardly slopped passageways in which the riders slid.

Previous improvements in the prior art slides include my earlier U.S. Pat. No. 5,137,497 to Dubeta, issued Aug. 11, 1992.

As the size of slide apparatuses (such as shown in my U.S. Pat. No. 5,137,497) increases, and the cost of labor and borrowing money increase, there is a requirement for a slide apparatus that can accommodate an even greater number of people in a shorter period of time.

The provision of such an improved slide apparatus would have the added benefit of shortening the time which passengers must wait in line. Such waiting is, needless to say, unacceptable to the majority of passengers; i.e., amusement park goers.

Accordingly, it can be seen that there is a need for a slide apparatus which can overcome these and other drawbacks of known devices.

OBJECTS AND SUMMARY OF THE INVENTION

It is an object of the invention to overcome the drawbacks of prior art slide apparatuses.

It is a further object of the invention to provide a slide apparatus which has a greater passenger throughput per hour than known devices, thereby shortening wait times for passengers, increasing the amusement value of the device, and maximizing the value of the installed device.

It is a further object of the invention to increase passenger throughput, yet without requiring greater water usage than existing devices.

A still further object is to lengthen the period of time during which a passenger is sliding, yet without increasing water usage, energy requirements, and space requirements, for example.

A further object of the invention is to provide an environmentally friendly water slide apparatus owing to its achieving the above objects of increased passenger throughput without increased demands for water, energy, and space, for example.

Another object of the invention is to provide a water slide having increased excitement value for the passengers, owing to its use of one or more switchback or "sidewinder" elements.

Yet another object of the invention is to provide a slide apparatus that changes the direction of travel of passengers in a small space, yet without the use of a dividing wall to separate passengers traveling in different (and even "opposite") directions.

A further object of the invention is to provide a slide apparatus which prevents users from engaging or "bouncing off" the sides of the pathways or trough, while achieving the desired speeds, excitement, and rapid changes of direction.

In summary, the invention is directed to a slide apparatus including at least one trough defining at least one path along which a passenger travels, and at least one switchback trough or switchback operatively connected to the trough.

The invention is likewise directed to a slide apparatus having at least one path of travel along which a passenger travels, and at least one switchback which changes the direction of travel of the user without the use of a portion of a spiral path to accomplish the change of direction.

The invention is directed to a switchback configured for directing passengers in different directions, yet without the use of a dividing wall to separate two(2) paths along which the user travels; i.e., a first path along which the user travels in the first direction, and a second path along which the user travels in a second (e.g., return direction).

It will be appreciated that relative terms such as up, down, left, and right are for convenience only, and are not meant to be limiting. The term user, for example, is intended to encompass all users, whether individual passengers sliding directly on the slide apparatus, sliding on a film or bed of water, sliding in a stream of water, sliding on conveyances, being carried mechanically along the slide apparatus, sliding on boats or tubes, or multiple passengers sliding with or without the use of conveyances.

Still further, the term "trough" is not intended to be limited to trough-like pathways along which a user may slide. The term trough, throughout the written description and claims, is intended to encompass all manners of pathways along which a user can slide, with or without accompanying water, and with or without the use of a conveyance on which the user travels.

DETAILED DESCRIPTION OF THE INVENTION

Figure 1:
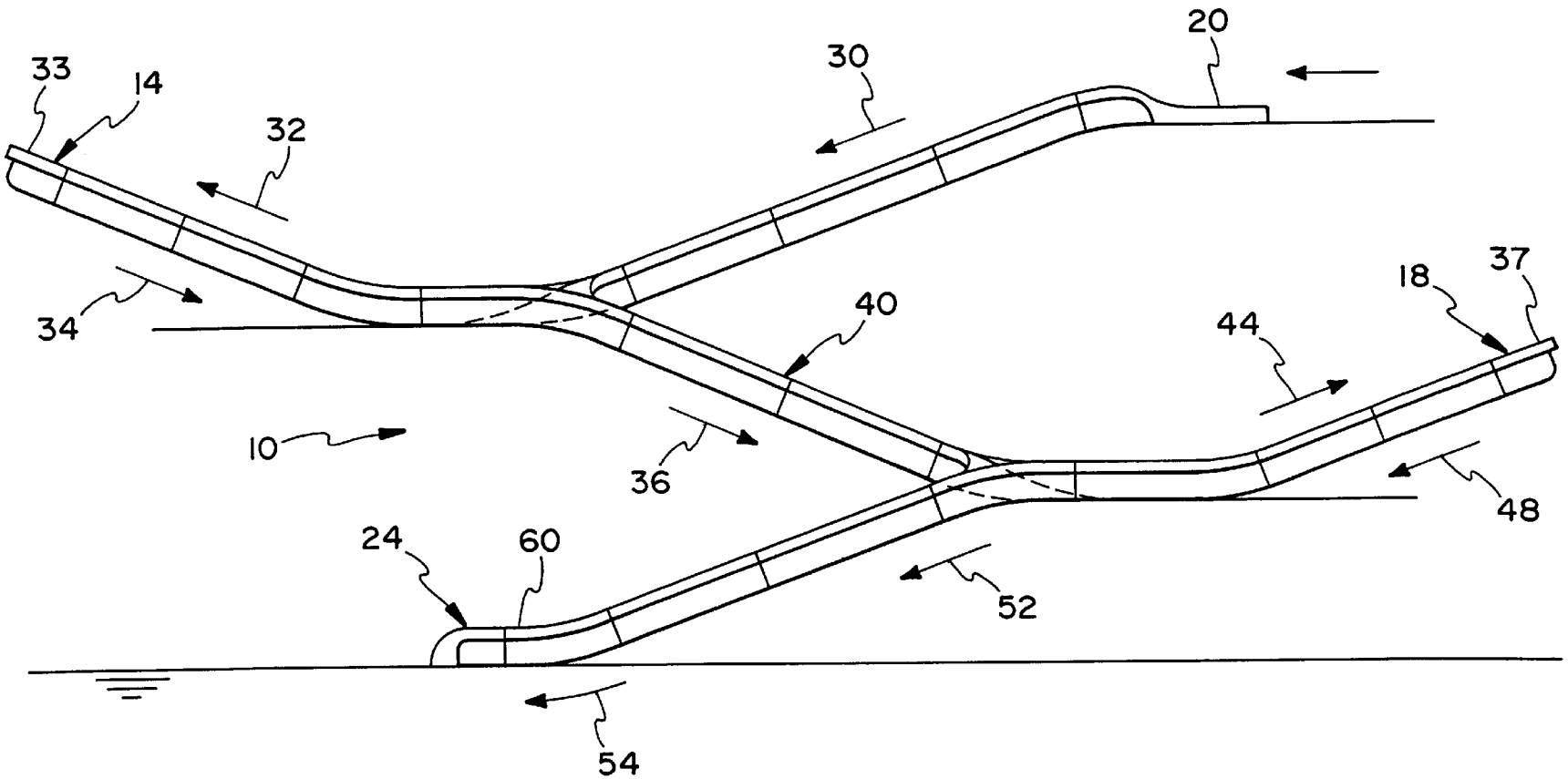
FIG. 1 illustrates a side view of a first preferred embodiment of a slide apparatus according the invention.

FIG. 1 illustrates a first preferred embodiment of a slide apparatus 10 according to the invention.

Slide apparatus 10 includes a left switchback 14 and a right switchback 18.

Typically, slide apparatus 10 will be provided with a starting area or a start tub 20 and an exit 24 which empties into a pool or runout, such as slow moving river.

Switchback elements 14 and 18, which have been termed "sidewinders", may be mirror images of each other, or may have distinct configurations.

Typically, the user enters at starting area 20, slides down in a direction 30 at least under the force of gravity, is pushed up or slid up against the force of gravity in a direction 32 toward the far left 33 of switchback 14 as shown in FIG. 1.

The user then returns in a direction 34 after a predetermined maximum height (i.e., an area in leftmost region 33 of switchback 14) has been achieved. The user continues on in a direction 36 along connecting slide or trough 40. The user's inertia carries the user upwardly and to the right in a direction 44 into switchback 18, until a predetermined rightmost height 37 has been achieved.

The user then starts sliding in a different (e.g., a substantially opposite) direction 48 downwardly to the left and continues on past connecting slide 40 in the directions of arrows 52 and 54 toward exit or runout 24.

The volume of water provided in a left portion 60 of exit 24 may be selected so that the user is stopped gradually or is provided with a large splash when the user encounters exit 24.

It will be appreciated that the slopes, heights, water volume, materials used, and the like may be varied so as to fine-tune the rate of speed of the users and/or the water volume requirements.

Figure 2:
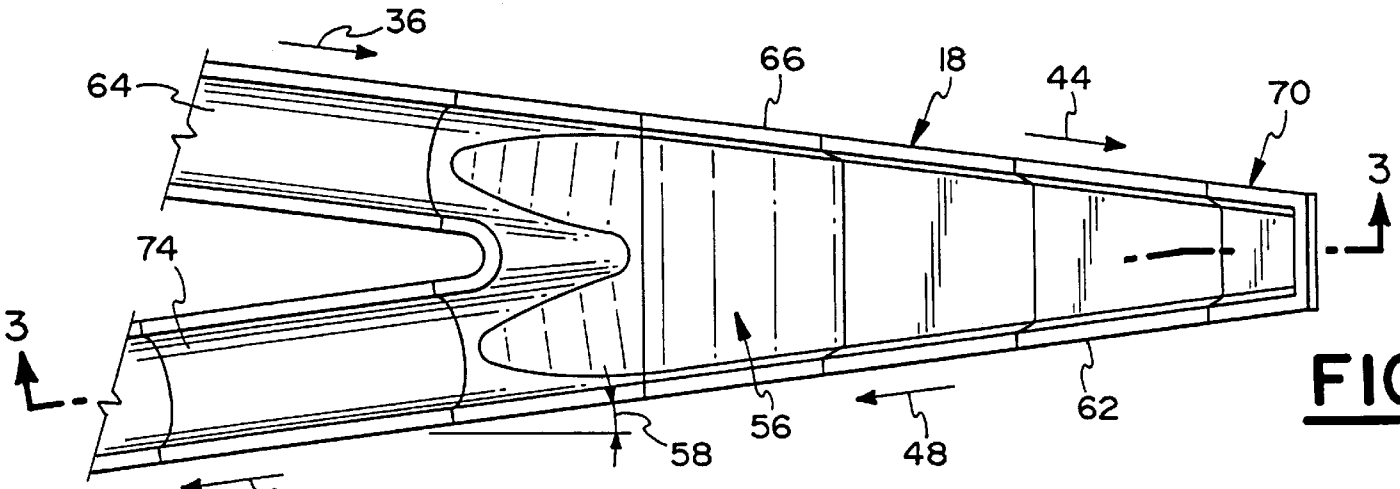
FIG. 2 is a top plan view of a switchback or sidewinder element according to the invention.

FIG. 2 is top plan view of a typical switchback or sidewinder element, such as switchback element 18 shown in FIG. 1.

As in FIG. 1, a user will enter switchback element 18 in direction 36 along a first trough or trough element or slide element 64. The user will continue in direction 44 until the user has reached an end region 70 at which the user's velocity has reached 0 owing to the slowing down of the user's rightward movement toward end region 70 owing to the force of gravity, the amount of water present, the material of the slide, the material of the passenger's conveyance, and the like. At that predetermined point in region 70, the user's velocity or speed will reach 0. At that point, the user will then begin moving ("accelerating") rearwardly in direction 48 and will continue to gain speed and will then pass into a second trough or slide element 74 in direction 52.

A portion 56 may be formed with gently curved surfaces to ensure that a user is directed in the desired direction from direction 36 into end region 70 of switchback 18, and then, when the user is returned along direction 52, the user is guided into the second trough element 74. Such gently sloping surfaces may be in the form of a part or all of a hyperbolic paraboloid.

FIG. 2 shows that the side walls 62 and 66 of the switchback element 18 may be inwardly angled at an angle 58 of greater than 0° or more. As shown, side walls 62 and 64 may be inwardly angled at about 7.5 degrees.

Figure 3:
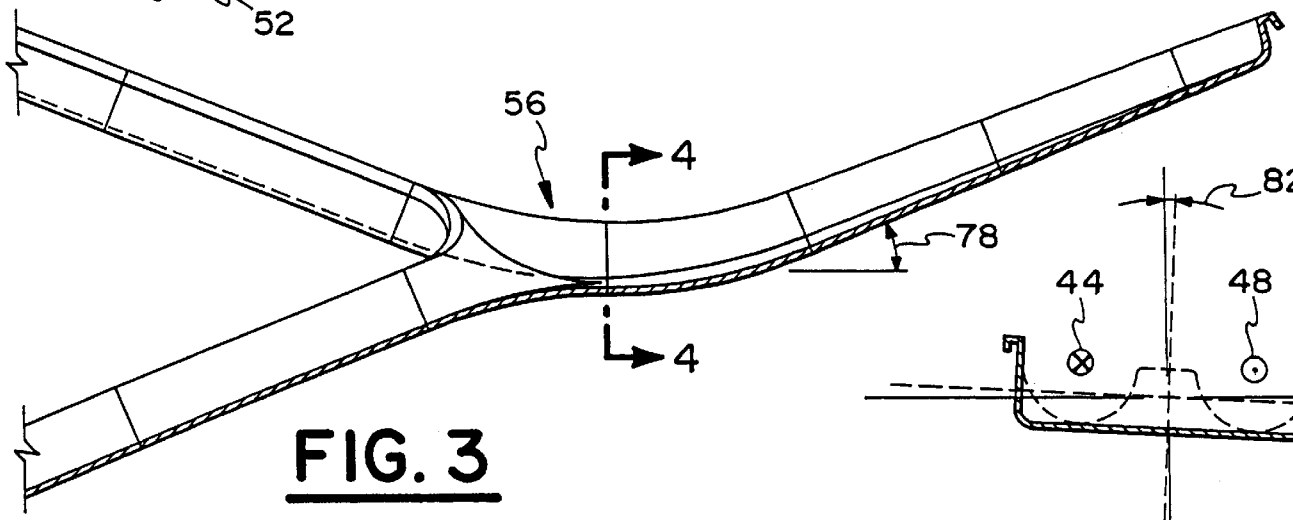
FIG. 3 is a partial sectional view taken along line 3—3 of FIG. 2.

FIG. 3 illustrates a side view thereof, with an example of the elevation of switchback element 44 relative to the horizon at an angle 78 greater than 0° or more. As shown, angle 78 may be about 22.5 degrees, for example. The angle(s) will be varied depending on the length of switchback element 18, the desired speed, water volume providing a braking effect, and the like.

Figure 4:
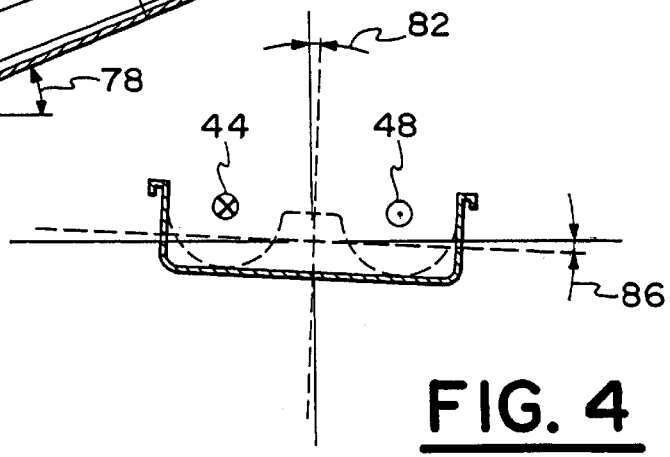
FIG. 4 is a partial sectional view taken along line 4—4 of FIG. 3.

FIG. 4 shows that switchback element 18 may be slightly angled relative to the vertical and relative to the horizontal axes, for example, to ensure that the user exits through second trough 74 instead of exiting up into a portion of first trough 64 after having reversed course. Such angling of second trough 74 relative to first trough 64 ensures that the passenger throughput is maintained at a high rate and that the passengers enjoy the maximum velocity afforded by the gravitational pull exerted on them after reaching the quiescent (i.e., zero (0) velocity) point in region 70.

The angling or tilting of switchback element 18 about its longitudinal axis at an angle 86, helps ensure that a user returning rearwardly in direction 48 will be directed into second trough element 74 (instead of into first trough element 64).

Depending on the width, length and other variations of switchback element 18, as well as water volume and the like, the inward angling of angle 82 may vary from being greater than 0° to 2 or 3° or more.

FIG. 4 shows switchback element 18 may be angled at an angle 86 of 2–3° relative to the horizontal, as well as angled at angle 82 about 2–3° relative to the vertical.

Please note that direction 33 in FIG. 4 indicates the user is moving away from the viewer. Direction 48 indicates the user is moving toward the viewer. In both cases, the user could be facing the viewer or could be facing from the viewer. For example, the user could be moving up switchback element 18 in direction 44 while facing forwardly; then, the same user could return in direction 48 either facing rearwardly or forwardly.

Figure 5:
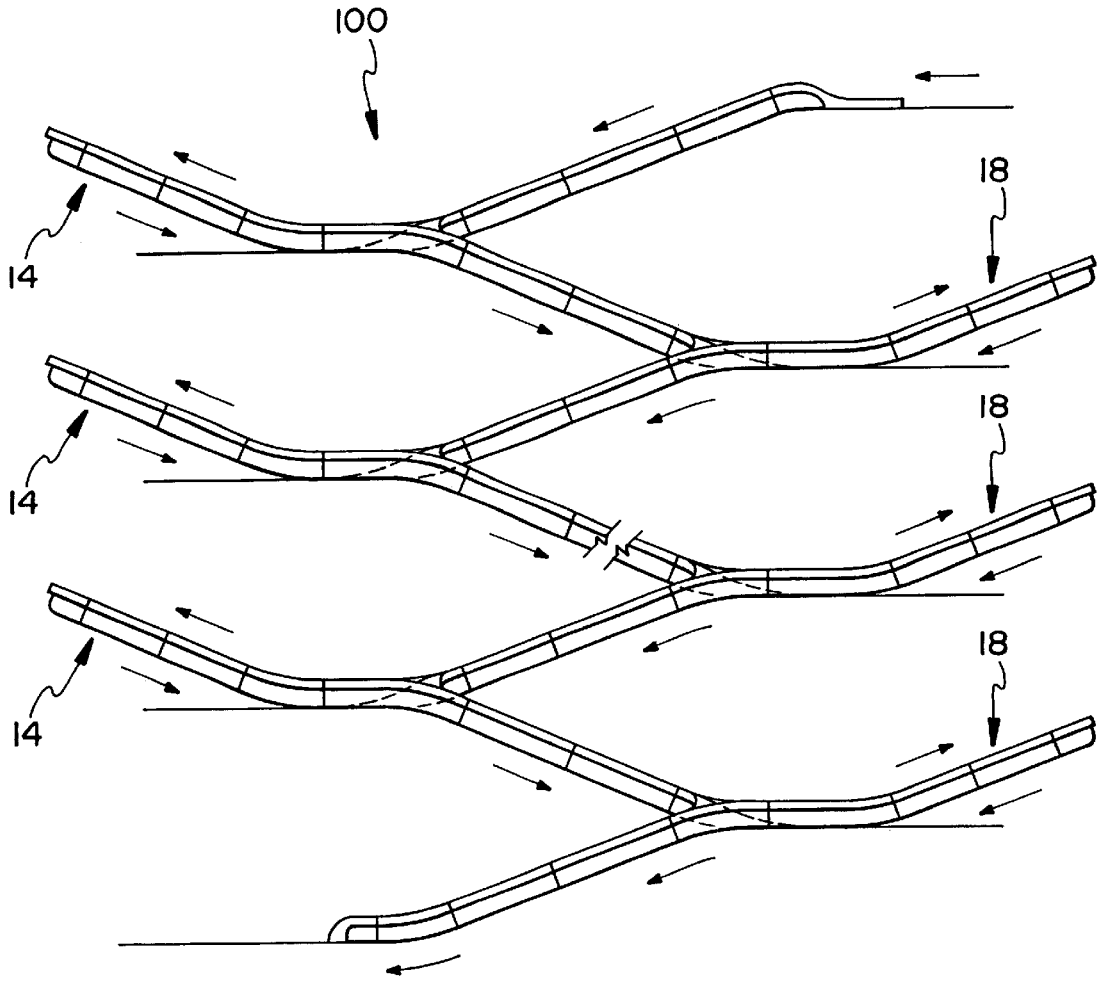
FIG. 5 illustrates a side view of a further preferred embodiment of a slide apparatus according to the invention.

FIG. 5 illustrates another preferred embodiment of a slide apparatus 100 having three(3) righthand and three(3) lefthand switchback elements 18 and 14, respectively. Switchback elements 18 and 14 may have the same or different configuration from those of FIG. 1. Any number of switchback elements may be provided.

As illustrated, slide apparatus 100 has three(3) righthand switchback elements 18 and three(3) left hand switchback elements 14.

FIGS. 6–14 illustrate another preferred embodiment of a switchback element 110 according to a further preferred embodiment of a invention. Switchback element 110 includes an upward travel region 112 and a downward travel region 116.

An entry 118 opens into upward travel region 112 at a portion thereof adjacent an opening into trough 64.

A further entry 120 opens into and is adjacent to an upper region of downward travel region 116.

Downward travel region 116 may be termed a return region or a return travel region, as travel region 116 is intended to guide and return the users returning in direction 48 after having reached an area near an outer end region 134. Return travel region 116 may be provided with an inner side wall and an outer side wall. The inner side wall may blend into or converge with the sideways outer portions of upward travel region 112.

Outer side wall 126 of downward travel region 116 will be configured for guiding users or passengers downwardly along the desired paths, such as into trough 74.

A lower or lowermost portion 132 of return travel region 116 may be provided to further guide and ensure that returning users are substantially free of engagement with upwardly moving users traveling in direction 44 along upward travel region 112.

Outer end region 134 may include a portion of switchback element 110 at which point the upward movement of the users has substantially stopped, and the downward movement of the user has begun; i.e., the point or region at which the user's velocity is approximately 0 m.p.h (km/h).

One or more strengthening elements 142 and 144 may be provided on switchback element 110. Strengthening elements 142, 144 may be made in the form of downwardly turned lips, as shown.

Additional strengthening ribs or supports 148 may be provided. In the case where switchback element is supported by a structural framework, strengthening ribs or supports 148 may be configured and be sufficiently large so as to be attached to the supporting framework. In the case where switchback element is a part of the slide system provided on a hillside, for example, strengthening ribs or supports 148 may form part of switchback element 110 that contacts the ground and supports switchback element 110 on the ground.

A curved guide portion 156 may be provided adjacent the transition between trough 64 and entry 118, and the transition between trough 74 and downward travel region 116 to further ensure that the users are guided in the desired direction in a smooth and efficient manner.

It will be appreciated that each of the elements shown in FIGS. 6–14 are configured and sized individually and collectively for ensuring the overall desired operation of switchback element 110.

As will be readily appreciated from considering FIGS. 6–14, and from the description of the other preferred embodiments, in use, a user, such a free sliding participant or a participant in an inner tube, enter switchback element 110 in direction 36 via trough 64. The user then travels upwardly in direction 44 until the user has, for example, reach upper region 134.

At that point, the user's speed is about 0 m.p.h. The user then returns in the opposite direction (i.e., direction 48) moving downwardly and is guided in downward travel region 116. The user's speed increases and the user exits into trough 74 for further travel in the direction 52.

Depending on the number of users in inner tubes linked together, their size and experience, for example, the user(s) may move from upward travel region 112 to downward travel region 116 at a point prior to reaching outer end region 134.

The size and configuration of upward travel region 112 and downward travel region 116 will be selected so that any premature entry into downward travel region 116 from upward travel region 112 may be controlled as desired by the fabricator and the operator. Desired throughput, the ages of the intended users, and the like will all play a role in selecting such. All such variations are within the scope of the invention.

Figures 6, 7:
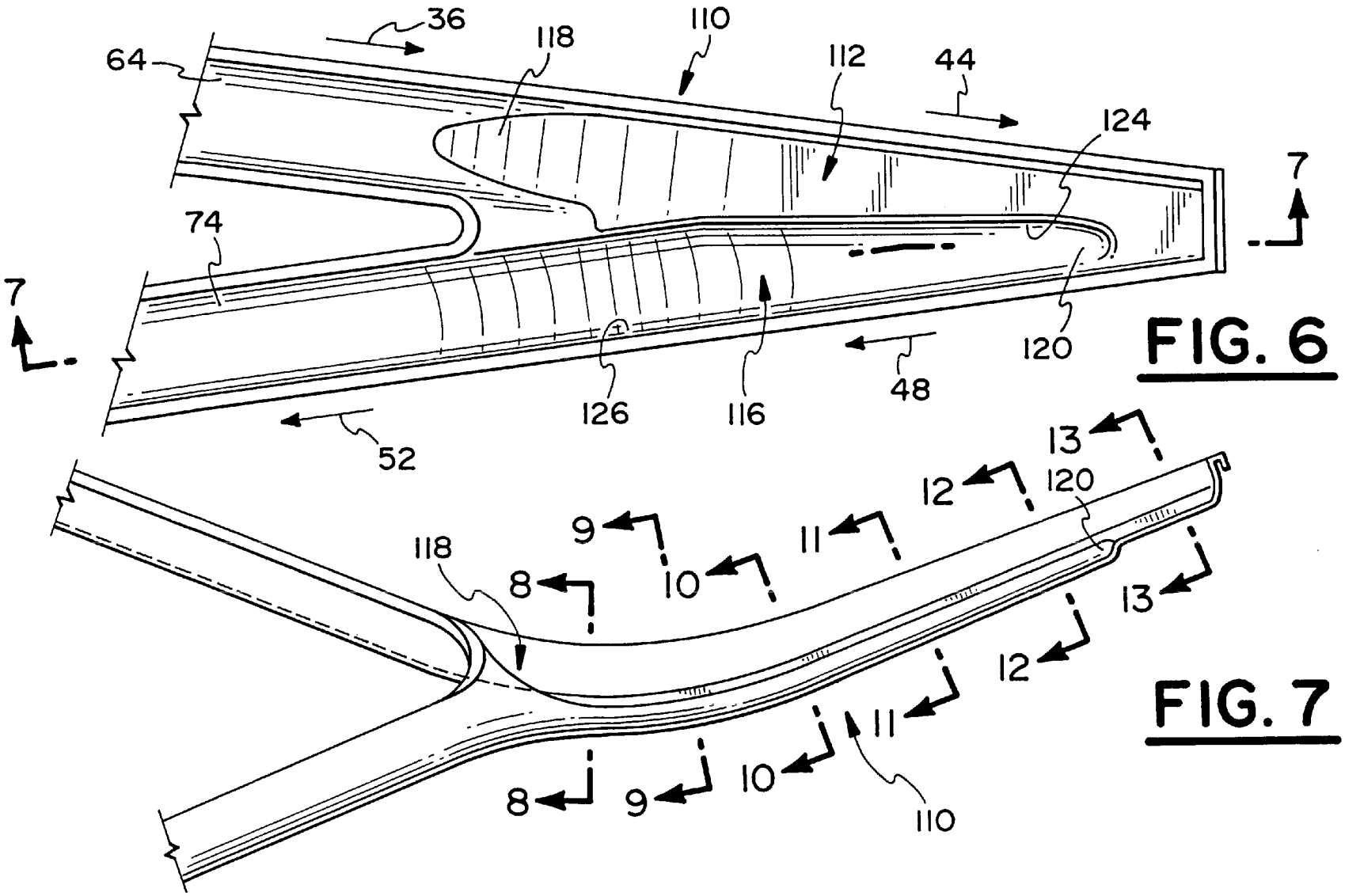
FIG. 6 is a top plan view, similar to FIG. 2, of a further preferred embodiment of a switchback element according to the invention.
FIG. 7 is a cross sectional side view of the switchback element of FIG. 6 according to the invention taken along line 7—7 of FIG. 6.
Figure 13:
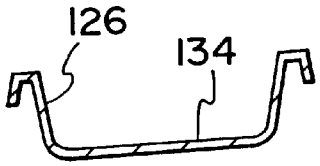
FIGS. 8–13 are sectional views of the switchback element of FIG. 6 according to the invention taken along lines 8—8, 9—9, 10—10, 11—11, 12—12, and 13—13 of FIG. 7.
Figure 12:
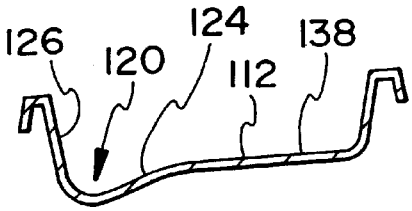
Figure 11:
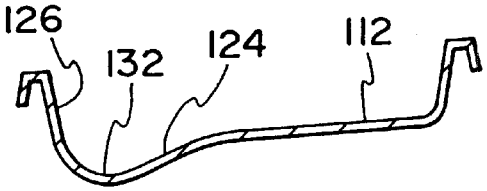
Figure 10:
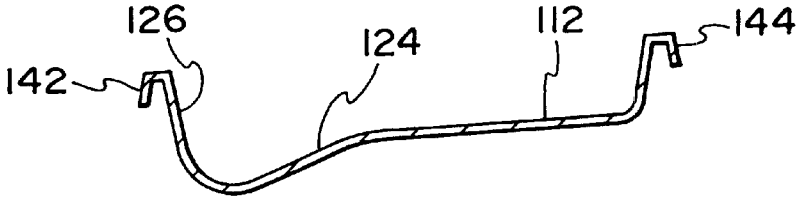
Figure 9:
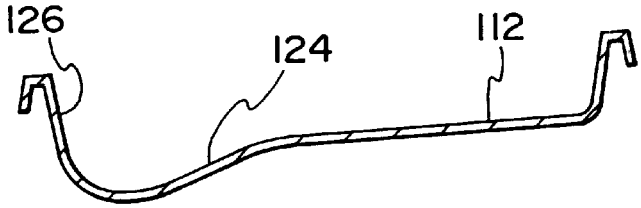
Figure 8:
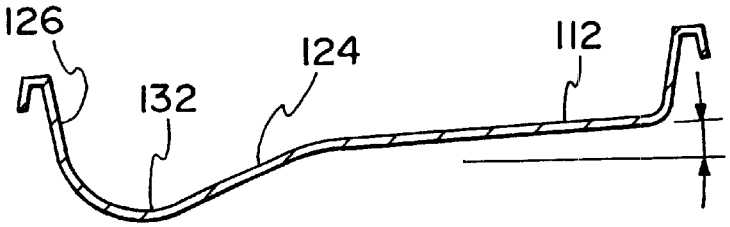
Figure 14:
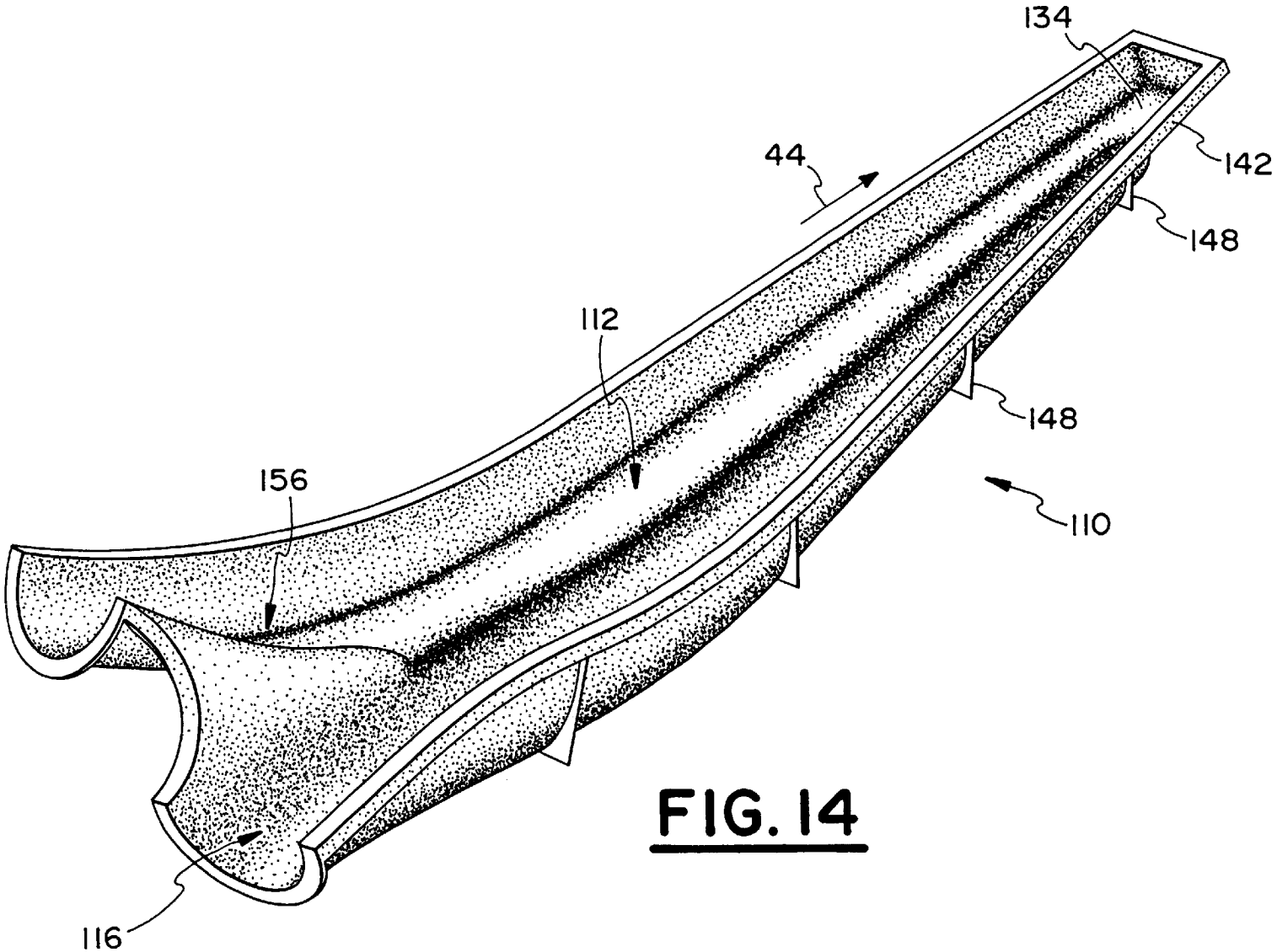
FIG. 14 is a top perspective view of the switchback element of FIG. 6 according to the invention.

It is likewise contemplated that the embodiment of FIG. 6 may be tilted relative to the vertical and relative to the horizontal, such as shown in the embodiment of FIGS. 1–5, particularly as shown in FIG. 4, should such prove desirable to a particular application.

The width and angling of the longitudinal axis of upward travel region 112 and of the downward travel region 116 will be selected so that the direction of the user is changed from up to 90°, and in many cases up to and including about 170° or 180[<b]old20 from the user's initial direction of travel.

In the embodiment of FIG. 6, although the direction of travel of the user has not been shown as having been changed by 18°, the direction of travel of the user has been shown as being changed by closer to about 170° or more.

The configuration of switchback 110 of the embodiment of FIGS. 6–14 ensures that the users do not strike or "bounce off" the outer sidewalls of switchback 110, for example. The slope of the switchback 110 may be selected so that the user gravitates toward, engages, and slides downwardly along the outer sidewall. Thanks to the configuration of switchback element 110 and upward travel region 112, as well as downward travel region 116, the desired relatively high rate of speed, excitement, and rapid and great change of direction of the path of travel of the users may be achieved without unnecessarily jarring the users.

Figure 15:
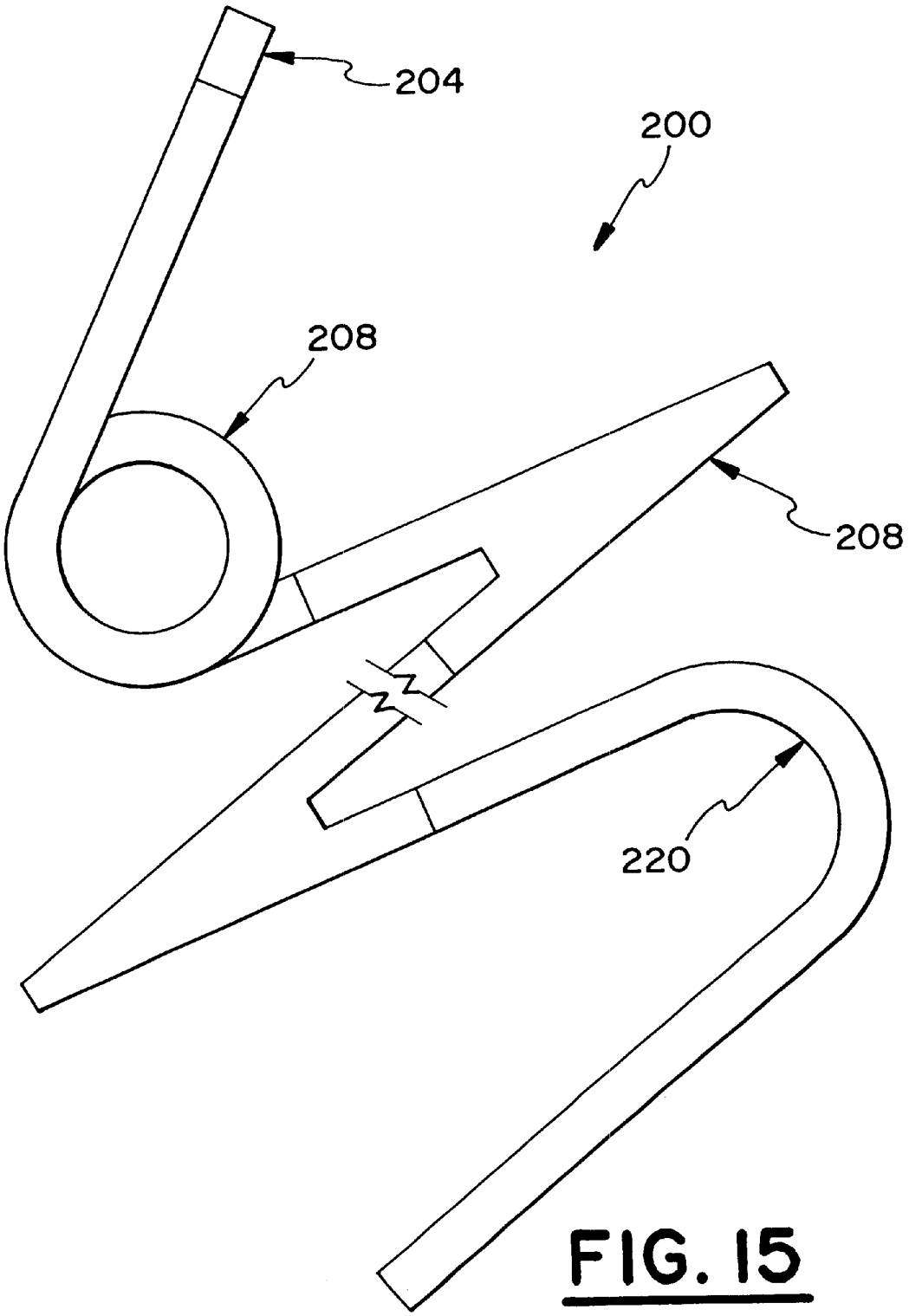
FIG. 15 is a schematic top plan view of another preferred embodiment of a slide apparatus according to the invention.

FIG. 15 illustrates a further preferred embodiment of a slide apparatus 200 according to the invention.

Slide 200 may include a start 204, a water slide flume 208 which may be made, as has been known in the past in the form of a spiral, and one or more righthand switchback elements 218 and lefthand switchback elements 214, as illustrated.

It is likewise contemplated that a further curved element 220 may be provided.

Curved element 220 may be steeply or gently sloped depending on the rate of speed at which the user is to exit slide 200 at an exit 230.

All or a portion of flume 208 may be used in the embodiment of FIG. 15.

It is contemplated that the wide surface of the slide troughs may be made from fiberglass reinforced plastic (FRP), other plastics, sheets of plastic bonded to the base of the trough, so-called gunite concrete products, and the like.

It is contemplated that speeds of from about 0 m.p.h. to about 10 m.p.h. or more will be typical, with higher speeds contemplated.

The slide may be made as a free-standing structure, or incorporated into other amusement rides, buildings, or hillsides, for example.

Further variations of production and assembly may be performed as set forth in U.S. Pat. No. 5,137,497 to Dubeta, which is incorporated herein by reference.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A slide apparatus comprising:

a) a trough having a top and a bottom, the top being elevated above the bottom, in use;

b) a slide surface provided on said trough;

c) said slide surface and said trough being configured so that a user slides on the slide surface from the top to the bottom along a substantially predetermined path, in use;

d) at least one switchback being provided in said slide surface;

e) said switchback being configured for causing, in use, a user traveling along the slide surface from the top to the bottom to be switched from a first direction of travel along the substantially predetermined path to a second direction of travel along the substantially predetermined path, the second direction of travel differing from the first direction of travel; and f) said switchback changing the direction of travel of the user by at least about 170 degrees.

2. An apparatus as in claim 1, wherein:

a) a first elevated portion is provided on said slide apparatus between said top and said bottom.

3. An apparatus as in claim 2, wherein:

a) said first elevated portion includes an upwardly sloping portion sloping sufficiently upwardly so as to reduce the rate of speed of a user sliding on the slide surface in use.

4. An apparatus as in claim 3, wherein:

a) said upwardly sloped portion includes a part of said switchback.

5. An apparatus as in claim 1, wherein:

a) said switchback changes the direction of travel of the user by about 180 degrees.

6. An apparatus as in claim 1, wherein:

a) said switchback includes an upwardly sloping portion, and said upwardly sloping portion is sufficiently long and sufficiently upwardly sloped so as to slow down the speed of the user on the slide surface, in use.

7. An apparatus as in claim 6, wherein:

a) said switchback is sufficiently upwardly sloped so that the speed of a user is reduced to substantially 0 miles per hour, in use.

8. An apparatus as in claim 6, wherein:

a) said switchback is sufficiently upwardly sloped so that the speed of a user is reduced to substantially 0 miles per hour, and then the user is accelerated in a different direction, in use.

9. An apparatus as in claim 8, wherein:

a) the slide surface of said trough has a substantially parabolic upwardly open cross-section.

10. An apparatus as in claim 1, wherein:

a) the slide surface of said trough has a substantially parabolic upwardly open cross-section.

11. An apparatus as in claim 1, wherein:

a) said switchback includes a slide surface defining at least a portion of a hyperbolic paraboloid.

12. An apparatus as in claim 1, wherein:

a) said trough includes a flume disposed between the top and the bottom.

13. An apparatus as in claim 12, wherein:

a) said flume includes a slide surface defining at least a portion of a spiral for causing a user to change direction by at least about 90 degrees as the user passes through the flume, in use.

14. An apparatus as in claim 13, wherein:

a) a second switchback is provided for changing the direction of a user, in use.

15. An apparatus as in claim 1, wherein:

a) at least two first switchbacks are provided, each of said at least two first switchbacks being configured for changing the direction of travel of a user, in use; and b) at least two second switchbacks are provided, each of said at least two second switchbacks being configured for changing the direction of travel of a user, in use.

16. An apparatus as in claim 15, wherein:

a) said at least two first switchbacks are provided on the left of said slide apparatus; and b) said at least two second switchbacks are provided on the right of said slide apparatus.

17. An apparatus as in claim 15, wherein:

a) at least one of said at least two switchbacks is substantially free of curved portions along the path of travel of the user, as viewed from a direction transverse to the path of travel.

18. An apparatus as in claim 1, wherein:

a) said switchback is substantially free of a portion of a spiral, as viewed from a direction transverse to the path of travel.

19. An apparatus as in claim 1, wherein:

a) said switchback includes a first slide surface and a second slide surface;

b) said first slide surface is configured for guiding a user in a first direction of travel;

c) said second slide surface is configured for guiding a user in a second direction of travel; and d) said first direction of travel differs from said second direction of travel.

20. An apparatus as in claim 19, wherein:

a) said first direction of travel is in an upward direction, and said second direction of travel is in a downward direction.

21. An apparatus as in claim 19, wherein:

a) said first slide surface of said switchback is substantially flat.

22. An apparatus as in claim 21, wherein:

a) said second slide surface of said switchback is curved.

23. An apparatus as in claim 22, wherein:

a) said first slide surface is disposed substantially adjacent said second slide surface.

24. An apparatus as in claim 23, wherein:

a ) said first slide surface and said second slide surface are substantially free of walls disposed between them.

25. An apparatus as in claim 1, wherein:

a) at least one sidewall is provided adjacent said slide surface.

26. An apparatus as in claim 25, wherein:

a) said at least one sidewall includes two sidewalls.

27. A slide apparatus comprising:

a) a trough having a top and a bottom, the top being elevated above the bottom, in use;

b) the trough including a first trough element having opposed sidewalls and a second trough element having opposed sidewalls;

c) a slide surface provided on said trough;

d) said slide surface being configured so that a user can slide on the slide surface from the top to the bottom;

e) at least one switchback being provided in said slide surface;

f) said switchback being configured for causing, in use, a user traveling along the slide surface from the top to the bottom to be switched from a first direction to a second direction of travel, the second direction of travel differing from the first direction of travel;

g) said switchback including a first slide surface and a second slide surface;

h) said first slide surface being configured for guiding a user from the first trough element and in the first direction of travel;

i) said second slide surface being configured for guiding a user in the second direction of travel and into the second trough element;

j) said first direction of travel differing from said second direction of travel; and k) said first direction of travel being substantially adjacent to said second direction of travel when viewed from above.

28. An apparatus as in claim 27, wherein:

a) said first direction of travel is directly adjacent to said second direction of travel when viewed from above.

29. An apparatus as in claim 27, wherein:

a) said first slide surface is disposed substantially adjacent said second slide surface.

30. An apparatus as in claim 27, wherein:

a) at least one sidewall is provided adjacent said slide surface.

31. An apparatus as in claim 30, wherein:

a) said at least one sidewall includes two sidewalls.

32. A slide apparatus comprising:

a) a trough having a top and a bottom, the top being elevated above the bottom, in use;

b) a slide surface provided on said trough;

c) said slide surface being configured so that a user can slide on the slide surface from the top to the bottom;

d) said trough including a first trough element and a second trough element;

e) at least one switchback being provided in said slide surface, said switchback being disposed between said first trough element and said second trough element;

f) said switchback being configured for causing, in use, a user traveling along the slide surface from the top to the bottom to be switched from a first direction of travel beginning in the first trough element to a second direction of travel, the second direction of travel differing from the first direction of travel; and g) said switchback changes the direction of travel of the user by at least about 170 degrees.

33. An apparatus as in claim 32, wherein:

a) said switchback includes an upwardly sloping portion, and said upwardly sloping portion is sufficiently long and sufficiently upwardly sloped so as to slow down the speed of the user on the slide surface, in use.

34. An apparatus as in claim 32, wherein:

a) a second switchback is provided for changing the direction of a user, in use.

35. An apparatus as in claim 32, wherein:

a) said switchback is sufficiently upwardly sloped so that the upward speed of a user is reduced to 0 miles per hour, in use.

36. A slide apparatus comprising:

a) a trough having a top and a bottom, the top being elevated above the bottom, in use;

b) a slide surface provided on said trough;

c) said slide surface and said trough being configured so that a user slides on the slide surface from the top to the bottom along a substantially predetermined path, in use;

d) at least one switchback being provided in said slide surface;

e) said switchback being configured for causing, in use, a user traveling along the slide surface from the top to the bottom to be switched from a first direction of travel along the substantially predetermined path to a second direction of travel along the substantially predetermined path, the second direction of travel differing from the first direction of travel; and f) said switchback changing the direction of travel of the user by at least about 170 degrees.

37. An apparatus as in claim 36, wherein:

a) a first elevated portion is provided on said slide apparatus between said top and said bottom.

38. An apparatus as in claim 37, wherein:

a) said first elevated portion includes an upwardly sloping portion sloping sufficiently upwardly so as to reduce the rate of speed of a user sliding on the slide surface in use.

39. An apparatus as in claim 38, wherein:

a) said upwardly sloped portion includes a part of said switchback.

40. An apparatus as in claim 36, wherein:

a) said switchback includes an upwardly sloping portion, and said upwardly sloping portion is sufficiently long and sufficiently upwardly sloped so as to slow down the speed of the user on the slide surface, in use.

41. An apparatus as in claim 36, wherein:

a) said switchback is sufficiently upwardly sloped so that the speed of a user is reduced to substantially 0 miles per hour, in use.

42. An apparatus as in claim 36, wherein:

a) the slide surface of said trough has a substantially parabolic upwardly open cross-section.

43. An apparatus as in claim 36, wherein:

a) said switchback includes a slide surface defining at least a portion of a hyperbolic paraboloid.

44. An apparatus as in claim 36, wherein:

a) said trough includes a flume disposed between the top and the bottom.

45. An apparatus as in claim 44, wherein:

a) said flume includes a slide surface defining at least a portion of a spiral for causing a user to change direction by at least about 90 degrees as the user passes through the flume, in use.

46. An apparatus as in claim 36, wherein:

a) said at least one switchback includes a second switchback provided for changing the direction of a user, in use.

47. An apparatus as in claim 36, wherein:

a) at least two first switchbacks are provided, each of said at least two first switchbacks being configured for changing the direction of travel of a user, in use; and b) at least two second switchbacks are provided, each of said at least two second switchbacks being configured for changing the direction of travel of a user, in use.

48. An apparatus as in claim 47, wherein:

a) said at least two first switchbacks are provided on the left of said slide apparatus; and b) said at least two second switchbacks are provided on the right of said slide apparatus.

49. An apparatus as in claim 47, wherein:

a) at least one of said at least two switchbacks is substantially free of curved portions along the path of travel of the user, as viewed from a direction transverse to the path of travel.

50. An apparatus as in claim 36, wherein:

a) said switchback is substantially free of a portion of a spiral, as viewed from a direction transverse to the path of travel.

51. An apparatus as in claim 36, wherein:

a) said switchback includes a first slide surface and a second slide surface;

b) said first slide surface is configured for guiding a user in a first direction of travel;

c) said second slide surface is configured for guiding a user in a second direction of travel; and d) said first direction of travel differs from said second direction of travel.

52. An apparatus as in claim 51, wherein:

a) said first direction of travel is in an upward direction, and said second direction of travel is in a downward direction.

53. An apparatus as in claim 51, wherein:

a) said first slide surface of said switchback is substantially flat.

54. An apparatus as in claim 53, wherein:

a) said second slide surface of said switchback is curved.

55. An apparatus as in claim 54, wherein:

a) said first slide surface is disposed substantially adjacent said second slide surface.

56. An apparatus as in claim 55, wherein:

a) said first slide surface and said second slide surface are substantially free of walls disposed between them.

57. An apparatus as in claim 36, wherein:

a) at least one sidewall is provided adjacent said slide surface.

58. A slide apparatus comprising:

a) a trough having a top and a bottom, the top being elevated above the bottom, in use;

b) a slide surface provided on said trough;

c) said slide surface and said trough being configured so that a user slides on the slide surface from the top to the bottom along a substantially predetermined path, in use;

d) at least one switchback being provided in said slide surface;

e) said switchback being configured for causing, in use, a user traveling along the slide surface from the top to the bottom to be switched from a first direction of travel along the substantially predetermined path to a second direction of travel along the substantially predetermined path, the second direction of travel differing from the first direction of travel;

f) said trough including a flume disposed between the top and the bottom; and g) said flume including a slide surface defining at least a portion of a spiral for causing a user to change direction by at least about 90 degrees as the user passes through the flume, in use.

59. An apparatus as in claim 58, wherein:

a) a second switchback is provided for changing the direction of a user, in use.

60. An apparatus as in claim 58, wherein:

a) said at least one switchback includes at least two first switchbacks, each of said at least two first switchbacks being configured for changing the direction of travel of a user, in use; and b) at least two second switchbacks are provided, each of said at least two second switchbacks being configured for changing the direction of travel of a user, in use.

61. An apparatus as in claim 60, wherein:

a) said at least two first switchbacks are provided on the left of said slide apparatus; and b) said at least two second switchbacks are provided on the right of said slide apparatus.

62. An apparatus as in claim 61, wherein:

a) at least one of said at least two switchbacks is substantially free of curved portions along the path of travel of the user, as viewed from a direction transverse to the path of travel.

63. An apparatus as in claim 58, wherein:

a) said switchback is substantially free of a portion of a spiral, as viewed from a direction transverse to the path of travel.

64. An apparatus as in claim 58, wherein:

a) said slide surface includes a first slide surface and a second slide surface;

b) said first slide surface is configured for guiding a user in a first direction of travel;

c) said second slide surface is configured for guiding a user in a second direction of travel; and d) said first direction of travel differs from said second direction of travel.

65. An apparatus as in claim 64, wherein:

a) said first direction of travel is in an upward direction, and said second direction of travel is in a downward direction.

66. An apparatus as in claim 64, wherein:

a) said first slide surface of said switchback is substantially flat.

67. An apparatus as in claim 66, wherein:

a) said second slide surface of said switchback is curved.

68. An apparatus as in claim 67, wherein:

a) said first slide surface is disposed substantially adjacent said second slide surface.

69. An apparatus as in claim 68, wherein:

a) said first slide surface and said second slide surface are substantially free of walls disposed between them.

70. An apparatus as in claim 58, wherein:

a) a first elevated portion is provided on said slide apparatus between said top and said bottom.

71. An apparatus as in claim 70, wherein:

a) said first elevated portion includes an upwardly sloping portion sloping sufficiently upwardly so as to reduce the rate of speed of a user sliding on the slide surface in use.

72. An apparatus as in claim 71, wherein:

a) said upwardly sloped portion includes a part of said switchback.

73. An apparatus as in claims 58, wherein:

a) said switchback changes the direction of travel of the user by more than 90 degrees.

74. An apparatus as in claim 58, wherein:

a) said switchback changes the direction of travel of the user by at least about 170 degrees.

75. An apparatus as in claim 74, wherein:

a) the slide surface of said trough has a substantially parabolic upwardly open cross-section.

76. An apparatus as in claim 58, wherein:

a) said switchback changes the direction of travel of the user by about 180 degrees.

77. An apparatus as in claim 58, wherein:

a) said switchback includes an upwardly sloping portion, and said upwardly sloping portion is sufficiently long and sufficiently upwardly sloped so as to slow down the speed of the user on the slide surface, in use.

78. An apparatus as in claim 77, wherein:

a) said switchback is sufficiently upwardly sloped so that the speed of a user is reduced to substantially 0 miles per hour, in use.

79. An apparatus as in claim 58, wherein:

a) said switchback is sufficiently upwardly sloped so that the speed of a user is reduced to substantially 0 miles per hour, and then the user is accelerated in a different direction, in use.

80. An apparatus as in claim 79, wherein:

a) the slide surface of said trough has a substantially parabolic upwardly open cross-section.

81. An apparatus as in claim 58, wherein:

a) said switchback includes a slide surface defining at least a portion of a hyperbolic paraboloid.

82. An apparatus as in claim 58, wherein:

a) at least one sidewall is provided adjacent said slide surface.

* * * * *